United States Patent [19]

Golbeck et al.

[11] 4,016,388

[45] * Apr. 5, 1977

[54] KEYBOARD SWITCH

[75] Inventors: Bernard J. Golbeck, Crystal Lake; Raymond F. Lewandowski, Mt. Prospect; William C. Markinson, Crystal Lake, all of Ill.

[73] Assignee: Oak Industries Inc., Crystal Lake, Ill.

[ * ] Notice: The portion of the term of this patent subsequent to Oct. 28, 1992, has been disclaimed.

[22] Filed: Jan. 27, 1975

[21] Appl. No.: 544,368

Related U.S. Application Data

[60] Division of Ser. No. 383,385, July 27, 1973, abandoned, which is a continuation-in-part of Ser. No. 279,378, Aug. 10, 1972, abandoned.

[52] U.S. Cl. ..... 200/314; 200/159 A

[51] Int. Cl.[2] ..... H01H 9/00

[58] Field of Search ..... 200/308–317, 200/159 A; 240/151, 152; 250/552

[56] References Cited

UNITED STATES PATENTS

| | | | |
|---|---|---|---|
| 2,420,066 | 5/1947 | Conway | 200/314 |
| 2,673,914 | 3/1954 | Sundt | 200/313 |
| 3,610,860 | 10/1971 | Baldwin | 200/315 |
| 3,632,938 | 1/1972 | Stessel | 200/314 |
| 3,749,872 | 7/1973 | Foster | 200/159 A |
| 3,916,131 | 10/1975 | Goldbeck et al. | 200/159 A |

OTHER PUBLICATIONS

Liebert, *P–n junctions as radiation sources*, Electronics, vol. 37, No. 20, July 13, 1964, p. 61.

*Primary Examiner*—Robert K. Schaefer
*Assistant Examiner*—Morris Ginsburg
*Attorney, Agent, or Firm*—Kinzer, Plyer, Dorn & McEachran

[57] ABSTRACT

A pushbutton switch has a base and a button telescopically movable on the base. There are a pair of terminals, with one of the terminals having a contact arm positioned within a switching chamber in the base. Movement of the button is effective to cause the contact arm to close upon the other terminal. The effective length of the contact arm is greater than its actual length. In one improvement, a light emitting device may be illuminated when the switch is operated. In another, a portion of the light emitting device forms the means to close the contact arm.

8 Claims, 7 Drawing Figures fig.1.
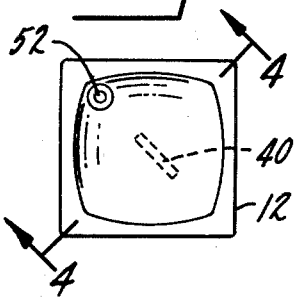
fig.2.
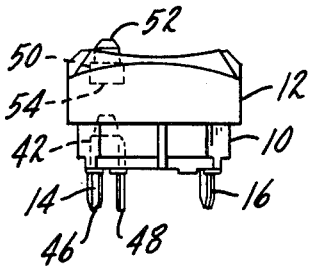
fig.3.
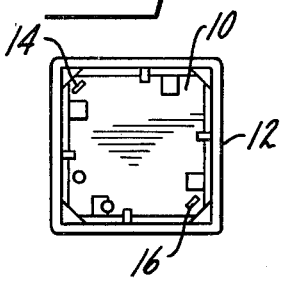
fig.4.
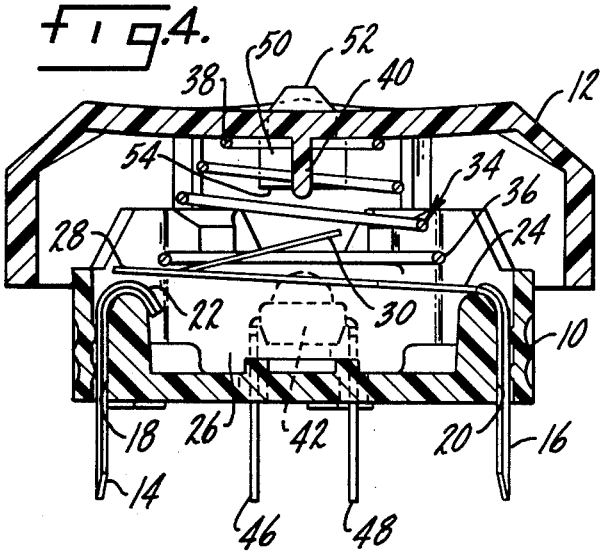
fig.5.
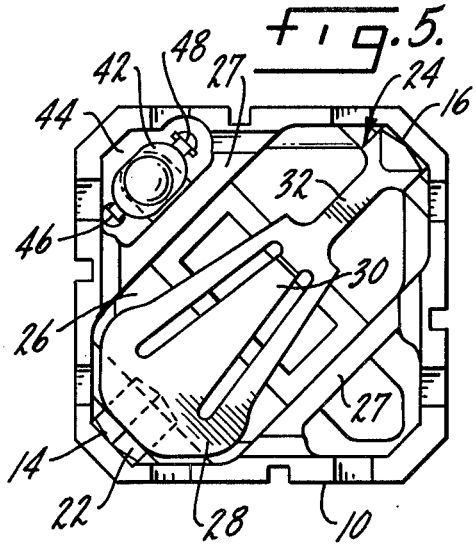
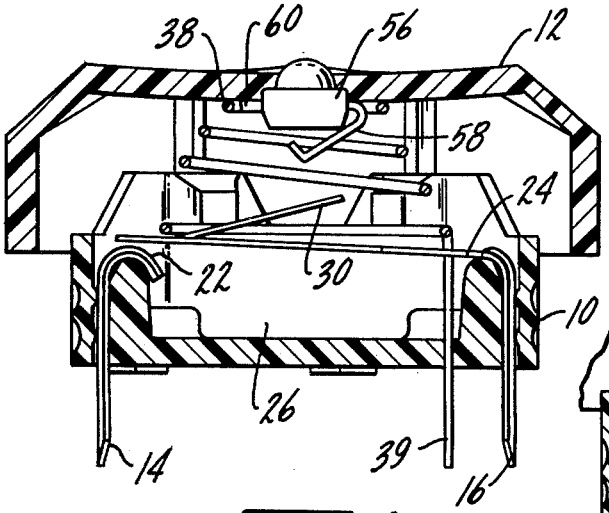
fig.6.
fig.7.
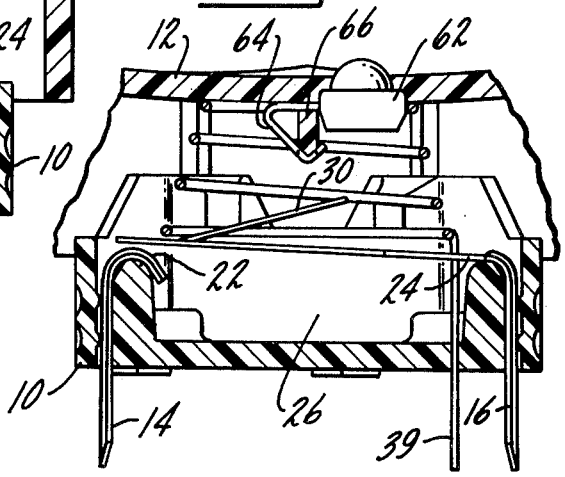

KEYBOARD SWITCH

The present application is a division of application Ser. No. 383,385, filed July 27, 1973, now abandoned, which was a continuation in part of application Ser. No. 279,378, filed Aug. 10, 1972, now abandoned.

SUMMARY OF THE INVENTION

The present invention relates to improvements in pushbutton switches.

One purpose of the present invention is a pushbutton switch of the type shown in the above-mentioned copending application including light indicating means.

Another purpose is a pushbutton switch of the type described in which the light indicating means forms a portion of the switch operator.

Other purposes will appear in the ensuing specification, drawings and claims.

BRIEF DESCRIPTION OF THE DRAWINGS

The invention is illustrated diagrammatically in the following drawings wherein:

FIG. 1 is a top view of a pushbutton switch,

FIG. 2 is a side view of the switch of FIG. 1,

FIG. 3 is a bottom view of the switch,

FIG. 4 is an enlarged section along plane 4—4 of FIG. 1,

FIG. 5 is an enlarged top plan view of the switch base,

FIG. 6 is a section, similar to FIG. 4, of a modified form of switch,

FIG. 7 is a partial section, similar to FIG. 6, showing a further modified form of switch.

DESCRIPTION OF THE PREFERRED EMBODIMENT

The present invention is useful as a keyboard switch, although it has wider application. An important consideration in such a switch is the contact arm, as it is one element which receives substantial wear and can cause the switch to become defective. In order to have a certain length of travel which permits positive opening and closing of the switch, and yet have a contact arm for the switch which will not break after lengthy use, it is desirable to increase the length of the contact arm. The longer the effective length of the contact arm, the less likelihood of the arm breaking after extensive use. Accordingly, the present invention is particularly directed to a pushbutton switch in which the effective length of the contact arm is greater than its actual length and is greater than the length of any side of the switch button.

The switch in the present application is described in detail in U.S. Pat. No. 3,916,131 having the same inventive entity as the present application. U.S. Pat. No. 3,916,131 was a continuation in part of now abandoned application Ser. No. 279,378, mentioned above. The specific disclosure of U.S. Pat. No. 3,916,131 is hereby incorporated by reference.

The switch may include a base 10 which is shown herein as generally square and which telescopically mounts a button 12 of generally the same configuration. Obviously other switch shapes are equally satisfactory. Terminals 14 and 16 are positioned within openings 18 and 20 in the base, with terminal 14 having a contact portion 22 positioned within an interior base chamber 26. Terminal 16 mounts a contact arm 24, integral therewith, which contact arm is positioned within the chamber 26 for contact with terminal portion 22.

The contact arm 24 has a wide portion 28, an integral part of which is an upwardly-extending arm 30. The arm 30 may be cut out of the arm 28 and, as clearly shown in FIG. 4, extends upwardly toward the button 12. Thus, the actual length of the contact arm, which is greater than the distance between terminals 14 and 16, is the sum of the portion 30 and the portion 28 and the narrow neck portion 32 directly adjacent terminal 16.

Positioned between the base 10 and the button 12 is a coil spring 34, with the lower larger coil 36 being seated upon rails 27 which form chamber 26. The smaller upper coil 38 is seated against the bottom surface of the button 12. In operation, normally the spring 34 maintains the button away from the base and thus contact arm 24 is positioned away from terminal portion 22. When the button is depressed, a downwardly-extending integral projection 40, a part of the button 12, strikes contact arm portion 30, causing the contact arm to move into electrical and mechanical contact with terminal 22.

The particular improvement illustrated in FIGS. 1–5 includes a light emitting diode 42 which is mounted in a small chamber 44 in one corner of the base 10. The diode 42 may have power terminals 46 and 48. Positioned directly above light emitting diode 42 and in alignment therewith is a light pipe 50, the upper end of which terminates in a conical portion 52 extending outwardly from the top of the button 12. Thus, when the light emitting diode is lighted, light from the diode 42 will be transmitted directly up the light pipe 50, which may be made of a suitable acrylic material, for display at the conical exterior portion 52. The terminals 46 and 48 may be so connected with the terminals 14 and 16, that any time the switch contacts are closed, diode 42 will be illuminated. In another form of switch, diode 42 may be constantly illuminated by independently wiring to terminals 46 and 48. The lower surface 54 of the light pipe 50 may be suitably formed so as to receive the upper end of diode 42, although this is not necessary. What is important is to provide an illumination conduit between the diode 42, through the light pipe, to the exterior display portion 52 on top of the switch button 12.

The constructions of FIGS. 6–7 have many parts similar to that described in FIGS. 1–5 and like parts have been given the same number. A light emitting diode is indicated at 56 in FIG. 6 and is generally centrally positioned in the switch button 12, rather than in a corner, as shown in FIG. 5. The diode 56 has a lower lead 58 which is in position to contact the contact arm 30. Another terminal 60 of the diode 56 is in electrical and mechanical contact with the upper spring coil 38, ending in a wire termination 39 off of bottom coil 36, which projects outside of base 10. Thus, when the button 12 of FIG. 6 is depressed, lead 58 of the diode will make contact with arm 30 and will thus complete an electrical connection through the diode when arm 30 contacts terminal 22. Lead 58 also provides a flexible means for closing contact 24 upon terminal portion 22. The light emitting diode not only performs an indicating or illuminating function in the structure of FIG. 6, but also provides the means for closing the switch contact.

In FIG. 7, a diode 62 has a lead 64 which is formed about an integral projection 66 forming a part of the button 12. Thus, in the structure of FIG. 7, the actuating projection of the button is rigid, whereas, in FIG. 6 it is flexible.

As described above, a light emitting device may be contained within the switch, but the terminals may be independent of the switch contacts. Therefore, the light emitting diode can be illuminated when the switch is operated, if so wired, or it can be operated by an external source independent of the switch contacts.

Whereas the preferred form of the invention has been shown and described herein, it should be realized that there may be many modifications, substitutions and alterations thereto.

The embodiments in which an exclusive property or privilege is claimed are defined as follows:

1. A pushbutton switch including a base, a button, co-operating means on said button and said base for mounting said button for telescopic movement toward and away from said base, spring means positioned between said button and said base and normally biasing said button away from said base, a pair of terminals extending outwardly from the base, one of said terminals supporting a relatively thin substantially flat flexible cantilever contact arm positioned within the base, said contact arm extending to a position immediately adjacent the other terminal and having an area disposed for contact with said other terminal, said contact arm having a relatively thin substantially flat flexible cantilever portion which extends outwardly from adjacent said area toward the button, means on the button positioned to contact said arm portion and apply force thereto in the direction of button movement and thus move said arm into contact with the other terminal when the button is moved relative to the base, said contact arm and arm portion having generally uniform flexibility over their entire path of movement, with said arm area beginning its movement toward said other terminal substantially simultaneously with initial engagement of said button means and said arm portion, the application force of the button being distributed along the cantilever arm portion and the cantilever contact arm, with the combined length of the cantilever arm portion and cantilever contact arm being greater than the distance between said terminals, light indicating means mounted on the base, and light display means mounted on the button in alignment with the light indicating means on the base.

2. The structure of claim 1 further characterized in that said light indicating means includes a light emitting diode and electrical terminals therefor extending outwardly from the base.

3. The structure of claim 1 further characterized in that said light display means includes a light pipe extending toward said light indicating means.

4. The structure of claim 1 further characterized in that said light indicating means and light display means are vertically aligned and positioned generally adjacent a corner of said base and button.

5. A pushbutton switch including a base, a button, co-operating means on said button and said base for mounting said button for telescopic movement toward and away from said base, spring means positioned between said button and said base and normally biasing said button away from said base, light indicating means attached to the button, said spring means including a terminal portion extending outwardly from the base, said light indicating means being electrically connected to said spring means, a pair of terminals extending outwardly from the base, one of said terminals supporting a relatively thin substantially flat flexible cantilever contact arm positioned within the base, said contact arm extending to a position immediately adjacent the other terminal and having an area disposed for contact with said other terminal, said contact arm having a relatively thin substantially flat flexible cantilever portion which extends outwardly from adjacent said area toward the button, said light indicating means having a portion thereof positioned to contact said arm portion and apply force thereto in the direction of button movement and thus move said arm into contact with the other terminal when the button is moved relative to the base, said contact arm and arm portion having generally uniform flexibility over their entire path of movement, with said arm area beginning its movement toward said other terminal substantially simultaneously with initial engagement of said portion of said light indicating means and said arm portion, the application force of the button being distributed along the cantilever arm portion and the cantilever contact arm, with the combined length of the cantilever arm portion and cantilever contact arm being greater than the distance between said terminals.

6. The structure of claim 5 further characterized in that said light indicating means includes a light emitting diode generally centrally positioned in said button.

7. The structure of claim 5 further characterized in that the portion of the light indicating means positioned to move said arm is flexible.

8. The structure of claim 5 further characterized in that the portion of the light indicating means positioned to move said arm is rigid.

* * * * *